US009085427B2

(12) United States Patent
Nogami

(10) Patent No.: US 9,085,427 B2
(45) Date of Patent: Jul. 21, 2015

(54) FEEDING DEVICE AND RECORDING APPARATUS

(71) Applicant: CANON KABUSHIKI KAISHA, Tokyo (JP)

(72) Inventor: Ryuji Nogami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/014,833

(22) Filed: Aug. 30, 2013

(65) Prior Publication Data

US 2014/0062001 A1 Mar. 6, 2014

(30) Foreign Application Priority Data

Aug. 30, 2012 (JP) ..... 2012-190012

(51) Int. Cl.
*B65H 3/52* (2006.01)
*B65H 3/06* (2006.01)
*B65H 3/56* (2006.01)

(52) U.S. Cl.
CPC ..... *B65H 3/06* (2013.01); *B65H 3/0669* (2013.01); *B65H 3/0684* (2013.01); *B65H 3/56* (2013.01); *B65H 2403/421* (2013.01); *B65H 2403/422* (2013.01); *B65H 2403/5331* (2013.01); *B65H 2403/942* (2013.01); *B65H 2405/1134* (2013.01); *B65H 2405/1136* (2013.01); *B65H 2801/12* (2013.01)

(58) Field of Classification Search
CPC ..... B65H 3/5223; B65H 3/56; B65H 3/0661; B65H 3/5261; B65H 3/5246; B65H 3/06; B65H 3/5238; B65H 3/02; B65H 3/52; B65H 3/5253
USPC ..... 271/121, 122, 124
See application file for complete search history.

(56) References Cited

U.S. PATENT DOCUMENTS

| | | | | |
|---|---|---|---|---|
| 6,217,017 | B1 * | 4/2001 | Yamazaki | 271/121 |
| 6,880,821 | B2 | 4/2005 | Park | |
| 2004/0065992 | A1 * | 4/2004 | Youn | 271/121 |
| 2005/0051945 | A1 * | 3/2005 | Kang | 271/121 |

FOREIGN PATENT DOCUMENTS

JP 3908991 B2 4/2007

* cited by examiner

*Primary Examiner* — Thomas Morrison
(74) *Attorney, Agent, or Firm* — Canon USA Inc. IP Division

(57) ABSTRACT

A feeding device includes a feed roller configured to feed stacked sheets, a first transmission unit configured to transmit driving force to the feed roller, a separating member configured to separate a sheet having been fed by the feed roller from the other sheets, a moving unit configured to move the separating member to a separating position where the separating member is in contact with the sheet to separate the sheet and a retracting position where the separating member does not separate the sheet, a second transmission unit configured to transmit driving force to the moving unit to work the moving unit, and a transmission unit configured to simultaneously transmit driving force of a drive source to the first transmission unit and the second transmission unit.

14 Claims, 19 Drawing Sheets

FEEDING DEVICE AND RECORDING APPARATUS

BACKGROUND OF THE INVENTION

1. Field of the Invention

The present invention relates to a feeding device for separately feeding sheets one by one to perform recording on the sheets and also relates to a recording apparatus including the feeding device.

2. Description of the Related Art

In general, recording apparatuses such as various printers and various facsimiles are each provided with a feeding device for separately feeding sheets of recording paper (hereinafter referred to as "paper") stored in a hopper one by one. As to feeding devices, a horizontal type feeding device for holding sheets of paper in horizontal attitude and an inclination type feeding device for holding sheets of paper in inclination attitude are employed. Recently, recording apparatuses of inclination type capable of reducing entire installation space for recording apparatuses have increased.

U.S. Pat. No. 6,880,821 discusses a configuration, as illustrated in FIG. 11, including fixed inclined surfaces 222 provided on a paper cassette and movable inclined surfaces 225 that are selectively movable as a selecting mechanism of a separating inclined surface for separating sheets of paper one by one. According to this mechanism, the movable inclined surface 225 can move to a position where the movable inclined surface 225 is not in contact with sheets of paper upon separation of sheets of paper.

Japanese Patent No. 3908991 discusses a selecting mechanism of a serrated member for selectively using the serrated member as a separating member according to the type of paper. As illustrated in FIG. 12, according to the selecting mechanism of the serrated member, the movable unit 313 lifts up/down the serrated member 312 toward/away from the feeding path of paper P according to the type of paper P, and the serrated member 312 prevents double feed of the paper P. Thus, it is possible to improve separation performance by using the serrated member 312 when paper P has poor separation performance, and possible to prevent bending or damage on soft paper P or glossy paper caused by the serrated member 312.

However, the selecting mechanisms according to the above conventional techniques are operated by using a drive source that is different from a drive source used for feed operation, or by once switching a driving state from a driving state of feed operation to a driving state for driving the selecting mechanism of the separating member. Alternatively, the selecting mechanism is operated by detecting a phase (turning position) of a separating member and the like by a phase detecting unit, and by operating the selecting mechanism at the same time with feed operation in phase synchronization with feed operation.

When a selecting mechanism is operated by using a drive source that is different from a drive source used for feed operation, the different drive source and a control device configured to control two drive sources are required, which results in increased manufacturing cost. When a selecting mechanism is operated by switching transmission of driving force in the driving state of feed operation, preparing operation for switching transmission of driving force is required before feed operation, which requires some time. When the selecting mechanism is performed in phase synchronization with feed operation, a phase detecting unit configured to detect a phase of the separating member and the like is required, which results in increased manufacturing cost.

SUMMARY OF THE INVENTION

The present invention is directed to a selecting mechanism of a separating member and a recording apparatus. The present invention is particularly directed to a selecting mechanism of a separating member and a recording apparatus configured to perform sheet feed operation and operation of selectively using a separating member by using a single drive source, thereby reducing time required for selecting a separating member and reducing manufacturing cost.

According to an aspect of the present invention, a feeding device includes a feed roller configured to feed stacked sheets, a first transmission unit configured to transmit driving force to the feed roller, a separating member configured to separate a sheet having been fed by the feed roller from the other sheets, a moving unit configured to move the separating member to a separating position where the separating member is in contact with the sheet to separate the sheet and a retracting position where the separating member does not separate the sheet, a second transmission unit configured to transmit driving force to the moving unit to work the moving unit, and a transmission unit configured to simultaneously transmit driving force of a drive source to the first transmission unit and the second transmission unit.

According to an exemplary embodiment of the present invention, a time required for selecting a separating member can be reduced, without providing a phase detecting unit for detecting a phase of the separating member, by using a drive source that is also used for feeding sheets.

Further features of the present invention will become apparent from the following detailed of exemplary embodiments with reference to the attached drawings.

DESCRIPTION OF THE EMBODIMENTS

Various exemplary embodiments, features, and aspects of the invention will be described in detail below with reference to the drawings.

Figure 1:
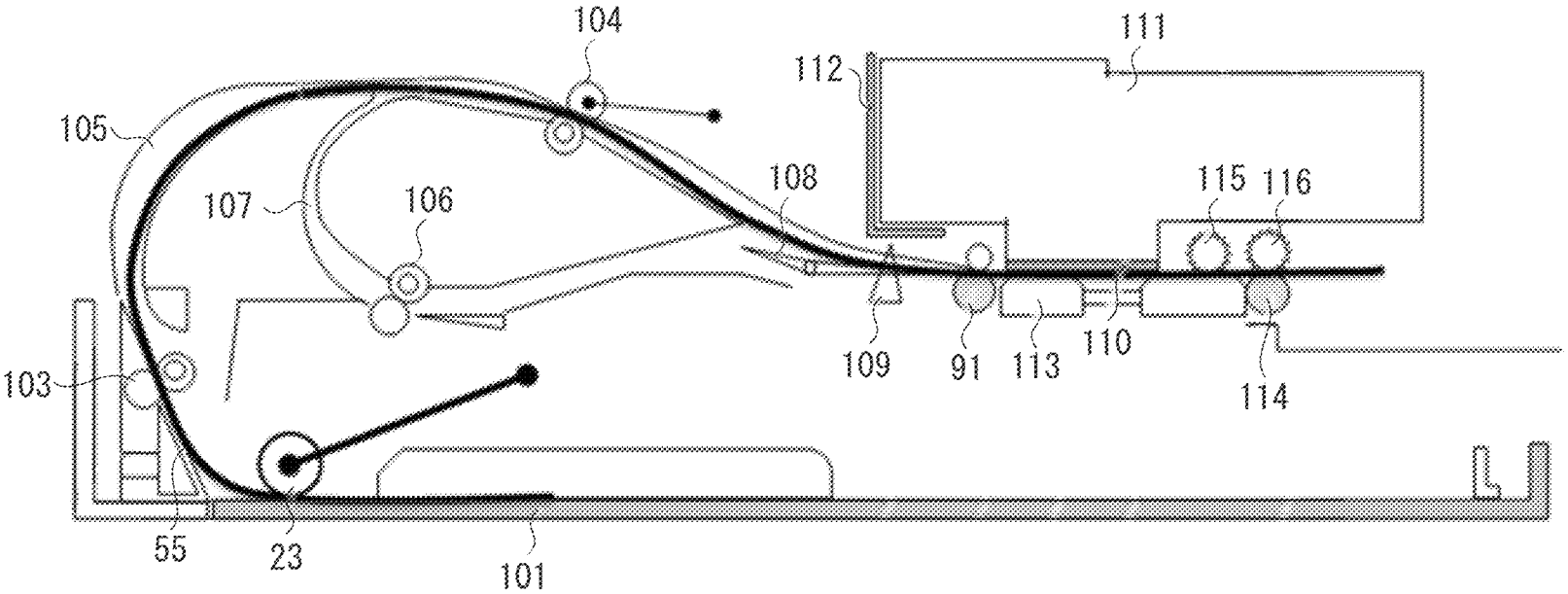
FIG. 1 schematically illustrates a configuration of a recording apparatus according to an exemplary embodiment.

FIG. 1 schematically illustrates a configuration of a recording apparatus according to an exemplary embodiment. On a cassette 101, sheets are stacked. A feed roller 23 feeds the stacked sheets. A separating inclined surface 55 separates one sheet having been fed from the other sheets. Intermediate conveyance rollers 103 and 104 convey the sheet having been fed along a conveyance path. A double-sided roller 106 reverses sides of a sheet using a double-sided conveyance path 107 after recording on the first side of the sheet from a recording unit, and then conveys the sheet back to the recording unit to perform recording on the second side of the sheet. A flapper (diverter) 108 directs a sheet from the recording unit to the double-sided conveyance path 107. A sensor 109 detects the leading edge and the trailing edge of a sheet being conveyed.

A conveyance roller 91 conveys a sheet, a recording head 110 performs recording by discharging ink onto a sheet being conveyed by the conveyance roller 91, and a carriage 111 is provided with the recording head 110. The carriage 111 is guided by a guide member 112 and moves reciprocally in directions orthogonal to the sheet conveyance direction along the upper side of a sheet. A platen 113 supports and guides a sheet in the recording unit, and a discharging roller 114 is provided. Spur rollers 115 and 116 have sharp protrusions protruding radially on their outer circumferential surfaces, and are rotary driven by a sheet being conveyed while the tips of the protrusions are in contact with the sheet. The spur roller 115 prevents a sheet from floating from the platen 113. The spur roller 116 and the discharging roller 114 pinch and convey a sheet.

Figure 2:
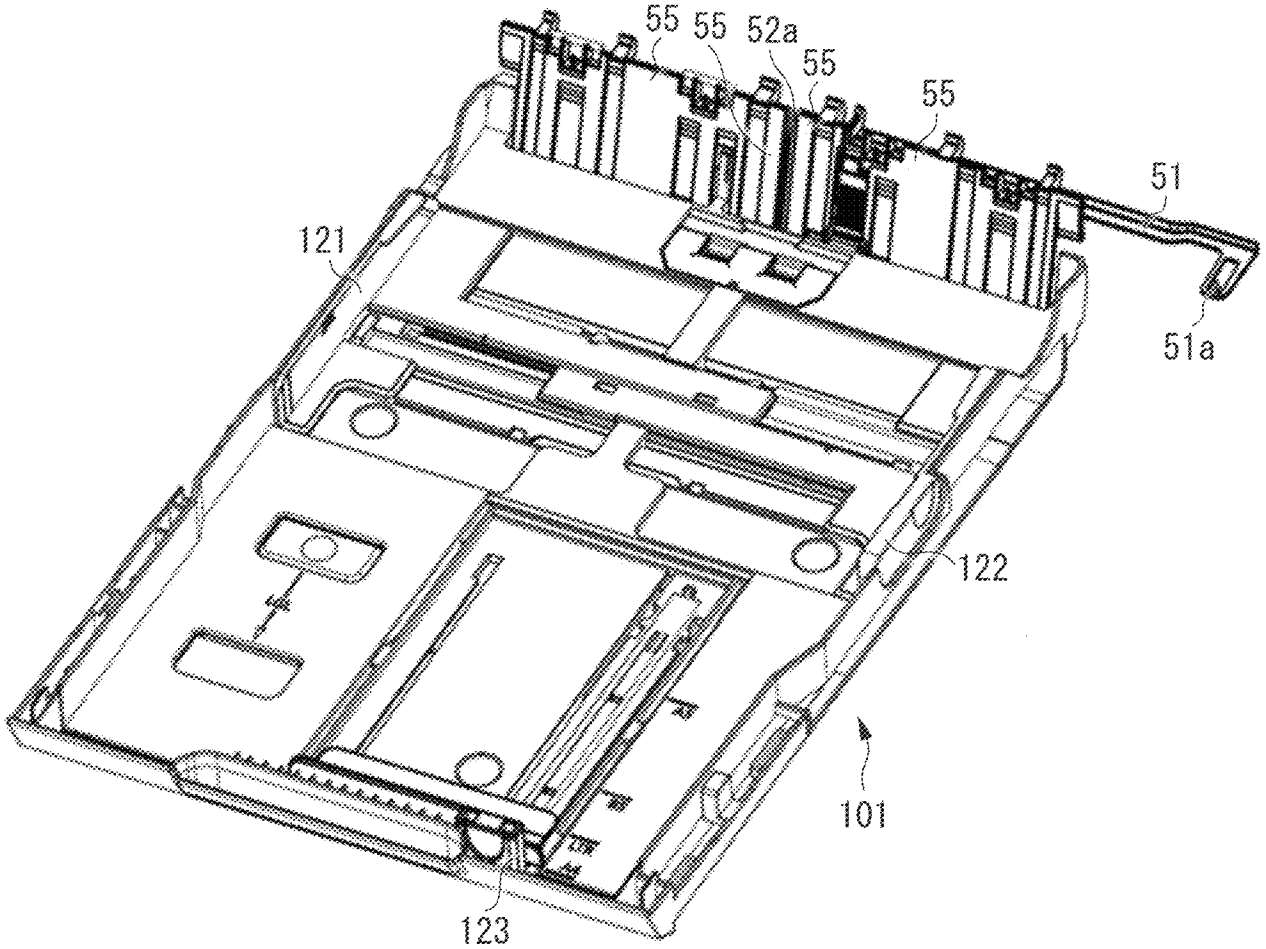
FIG. 2 illustrates a cassette mounted on the recording apparatus.

FIG. 2 illustrates the cassette 101 mounted on the recording apparatus. The cassette 101 includes a left side guide for restricting the position of the left edge of stacked sheets, a right side guide for restricting the position of the right edge thereof, and a trailing edge restricting guide for restricting the position of the trailing edge. The cassette 101 has no wall on a side from which a sheet is fed by the feed roller 23, and leading edges in the feeding direction of the stacked sheets face the separating inclined surface 55 provided on a recording apparatus body. On the separating inclined surface 55, a separating member 52 (FIG. 9B) is arranged in such a manner that a surface 52*a* thereof is parallel to the separating inclined surface 55 and that the separating member 52 protrudes from the separating inclined surface 55. As described below, the surface 52*a* of the separating member 52 is movable from a separating position where the surface 52*a* protrudes from the separating inclined surface 55 to a retracting position where the surface 52*a* recedes from the separating inclined surface 55.

The surface 52*a* of the separating member 52 facing the sheet leading edges applies larger resistance to a sheet to be fed than the separating inclined surface 55. On the surface 52*a*, a serrated shape having repeated protrusions and recesses in the feeding direction is formed, for example. Alternatively, the surface 52*a* is formed of a material having a coefficient of friction larger than the separating inclined surface 55. The application of resistance to the leading edge of a sheet to be fed by the surface 52*a* of the separating member 52 separates one sheet on the top of stacked sheets from the other sheets and allows the sheet to advance.

Figure 3:
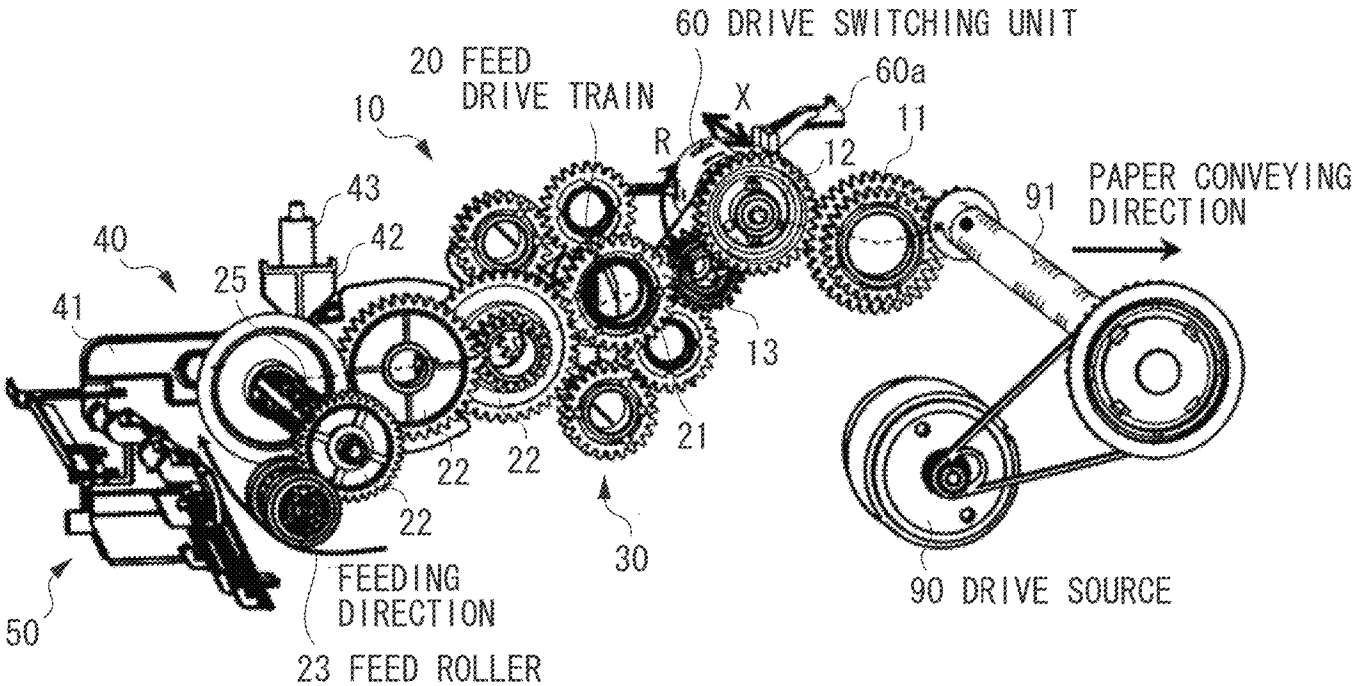
FIG. 3 is a perspective view illustrating a selecting mechanism of a separating member provided in the recording apparatus according to the exemplary embodiment.
Figure 4:
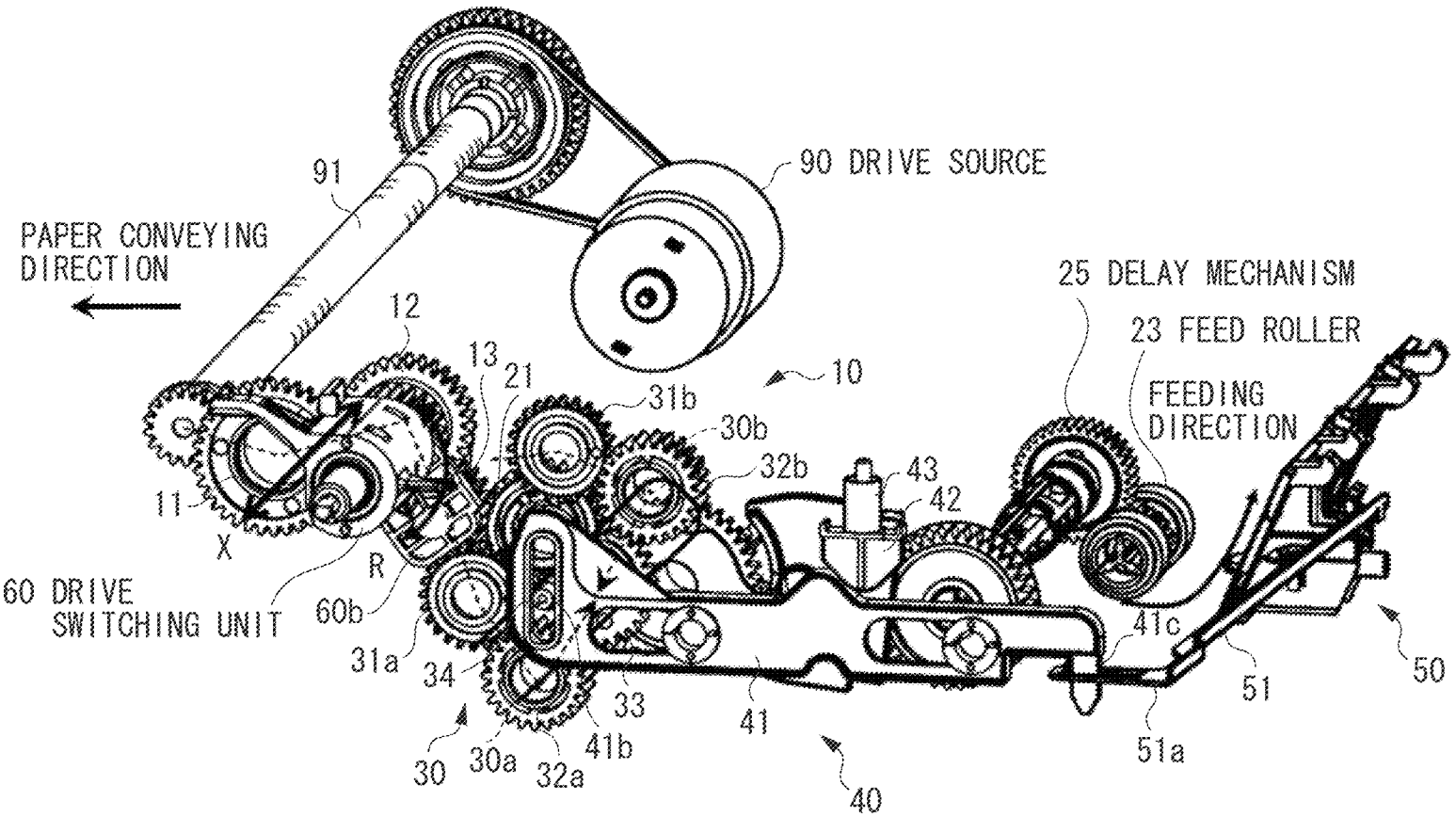
FIG. 4 is a perspective view illustrating the selecting mechanism of the separating member provided in the recording apparatus according to the exemplary embodiment.

Next, FIG. 3 is a perspective view of a selecting mechanism of the separating member in the recording apparatus according to the present exemplary embodiment. FIG. 4 is a perspective view of the selecting mechanism of the separating member in the recording apparatus according to the present exemplary embodiment as seen from the opposite side of FIG. 3.

The recording apparatus according to the present exemplary embodiment is provided with the selecting mechanism of the separating member for selectively using the separating member 52. The separating member 52 is provided to be movable to a plurality of positions along the sheet feeding path.

As illustrated in FIG. 3, in the selecting mechanism of the separating member, a drive source 90 having a direct-current (DC) motor and the like rotatably drives the conveyance roller 91, and the conveyance roller 91 transmits driving force to a drive train 10.

The drive train 10 includes a feed drive train 20 for transmitting driving force from the drive source 90 to the feed roller 23 for feeding a sheet, and a plurality of separating member selective-drive trains 30 (30*a* and 30*b*) for selectively working the separating member.

The drive train 10 further includes a drive switching unit 60 as a drive selecting mechanism for transmitting driving force from the drive source 90 by selecting one of the separating member selective-drive trains 30*a* and 30*b*. The selecting mechanism of the separating member is connected to the separating member selective-drive trains 30*a* and 30*b*, and includes a separating member selecting lever unit 40 as a separating member working mechanism for selectively working the separating member.

The drive source 90 is connected to one of the separating member selective-drive trains 30*a* and 30*b*, and is also connected to the feed drive train 20 at the same time. That is, the feed drive train 20 and one of the separating member selective-drive trains 30*a* and 30*b* are connected to the drive source 90 to be driven at the same time by the drive source 90.

As illustrated in FIGS. 3 and 4, the drive train 10 includes the feed drive train 20 (a gear train connected by a broken line in FIG. 3) as a first transmission unit, and the separating member selective-drive trains 30 (gear trains connected by broken lines in FIG. 4) as a second transmission unit. The feed drive train 20 and the separating member selective-drive trains 30 are configured to include the same drive train including the drive source 90, an idler gear 11, a sun gear 12, and a planetary gear 13 in this order.

The drive switching unit 60 can mesh the planetary gear 13 with a first separating member selecting gear 31*a* as a first part to transmit driving force to the separating member selective-drive train 30*a*. The drive switching unit 60 can also mesh the planetary gear 13 with a second separating member selecting gear 31*b* as a second part to transmit driving force to the separating member selective-drive train 30*b*.

The drive switching unit 60 is configured to be movable in the direction of an arrow X in conjunction with recording operation including movement of the carriage (111) for holding the recording head. Specifically, the carriage 111 abuts against a lever 60*a* of the drive switching unit 60 illustrated in FIG. 3, and pushes the drive switching unit 60 in the depth direction in FIG. 3, so that the drive switching unit 60 moves in the depth direction. With the carriage 111 moving away from the lever 60*a*, the lever 60*a* moves back to its original position due to urging force of a spring.

As illustrated in FIG. 4, an arm 60*b* as a supporting member rotatably supports the planetary gear 13, and a rotation shaft of the sun gear 12 rotatably supports the arm 60*b*. The arm 60*b* moves in the direction X in conjunction with movement of the drive switching unit 60 in the direction X. In order to switch drive selection, the carriage 111 moves the arm 60*b* in the depth direction in FIG. 3 to move the planetary gear 13 to a position where the planetary gear 13 does not mesh with any of the sun gear 12, the first separating member selecting gear 31*a*, or the second separating member selecting gear 31*b*. At this time, the arm 60*b* is connected to the rotation shaft of the sun gear 12 using a clutch, and comes into a state of rotating integrally with the rotation shaft of the sun gear 12. Then, driving force of the drive source 90 rotates the rotation shaft of the sun gear 12. As a result, the planetary gear 13 can be moved. The rotation shaft of the sun gear 12 rotates to move the planetary gear 13 to a first position where the planetary gear 13 meshes with the first separating member selecting gear 31*a*, or to a second position where the planetary gear 13 meshes with the second separating member selecting gear 31*b*. Then, the carriage 111 is disconnected and the drive switching unit 60 is moved in the depth direction in FIG. 4 to move the planetary gear 13 to a position where the planetary gear 13 meshes with the sun gear 12 and either the first separating member selecting gear 31*a* or the second separating member selecting gear 31*b* as selected. At this time, the arm 60*b* engages with an engaging protrusion that is not illustrated, and is restricted from turning, which fixes a position of the rotation center of the planetary gear 13.

The feed drive train 20 includes a feeding gear 21 meshing with the planetary gear 13. The feeding gear 21 meshes with the planetary gear 13 at either a position where the planetary gear 13 meshes with the first separating member selecting gear 31*a* or a position where the planetary gear 13 meshes with the second separating member selecting gear 31*b*. The feeding gear 21 does not mesh with the planetary gear 13 that is moved by the carriage 111 to a position where the planetary gear 13 does not mesh with the first separating member selecting gear 31*a* or the second separating member selecting gear 31*b*.

Driving force transmitted from the planetary gear 13 to the feeding gear 21 is then transmitted to a plurality of feed idler gears 22, a delay mechanism 25, and the feed roller 23. As illustrated in FIG. 4, the delay mechanism 25 is configured in such a manner that an input side rib can move in a groove shape formed in an output shaft. Therefore, when driving force is transmitted to the feed idler gears 22 on the input side, the delay mechanism makes the input side idle for a certain number of rotations and then transmits the driving force to the feed roller 23 on the output side. Thus, the delay mechanism 25 outputs driving force input from the drive source 90 to the feed roller 23 with some delay.

When the conveyance roller 91 rotates the drive source 90 to convey a sheet in the sheet conveying direction, the drive source 90 drives the feed drive train 20, and the feed drive train 20 rotates the feed roller 23 in the feeding direction in which a sheet is fed.

In addition, switching of the drive switching unit 60 makes it possible to release connection between the planetary gear 13 and the feeding gear 21, and then to stop the feed roller 23 from rotating in the feeding direction.

As illustrated in FIG. 4, the separating member selective-drive trains 30 are configured to include the same drive train from the drive source 90 to the planetary gear 13 as that of the feed drive train 20 as described above.

The planetary gear 13 is selectively connected to the first separating member selective-drive train 30*a* or the second separating member selective-drive train 30*b* by switching the drive switching unit 60. The planetary gear 13 is arranged in a manner such that the planetary gear 13 can be connected to the first separating member selective-drive train 30*a* or the second separating member selective-drive train 30*b* that has been selected, and also to the feeding gear 21 at the same time. Therefore, the separating member selective-drive train 30 and the feed drive train 20 are configured to be driven by the drive source 90 at the same time.

The first separating member selective-drive train 30*a* and the second separating member selective-drive train 30*b* join at a separating member selecting segment gear 33. To the separating member selecting segment gear 33, the separating member selecting lever unit 40 and a separating member unit 50 are connected in this order.

Figure 5:
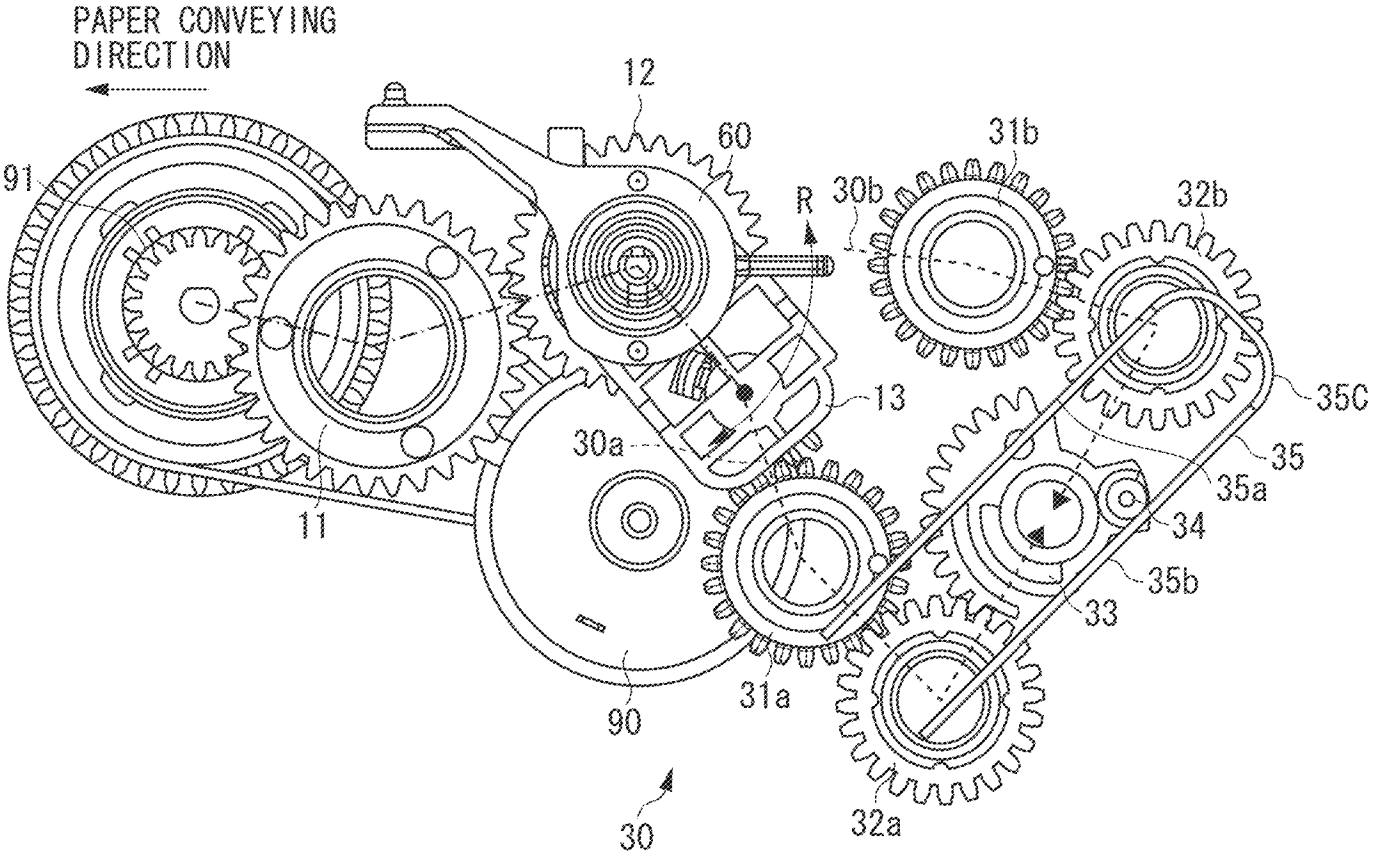
FIG. 5 is a side view illustrating the selecting mechanism of the separating member provided in the recording apparatus according to the exemplary embodiment.

FIG. 5 is a detailed side view of the recording apparatus according to the present exemplary embodiment. The separating member selective-drive train 30 is described in detail.

As indicated by a broken line in FIG. 5, the first separating member selective-drive train 30*a* includes the first separating member selecting gear 31*a*, a first separating member selecting idler gear 32*a*, and the separating member selecting segment gear 33 that are connected in this order. Similarly, the second separating member selective-drive train 30*b* includes the second separating member selecting gear 31*b*, a second separating member selecting idler gear 32*b*, and the separating member selecting segment gear 33 that are connected in this order.

As illustrated in FIG. 5, the separating member selecting segment gear 33 is a segment gear provided with a gear part only at a part of its outer circumference portion (a half of the circumference). On a side surface of the separating member selecting segment gear 33, a rod-like shaft 34 is provided. As illustrated in FIG. 4, the shaft 34 is connected to the separating member selecting lever unit 40. Around the separating member selecting segment gear 33, torsion spring 35 is provided to have the shaft 34 between arm parts 35*a* and 35*b* of the torsion spring 35 as illustrated in FIG. 5. The torsion spring 35 is provided as a toggle spring for restricting the separating member selecting segment gear 33 to rotate in one direction. The torsion spring 35 includes the two arm parts 35*a* and 35*b* and a connection part 35*c* for connecting the arm parts 35*a* and 35*b*. The connection part 35*c* is fixed to an apparatus body.

Figure 6A:
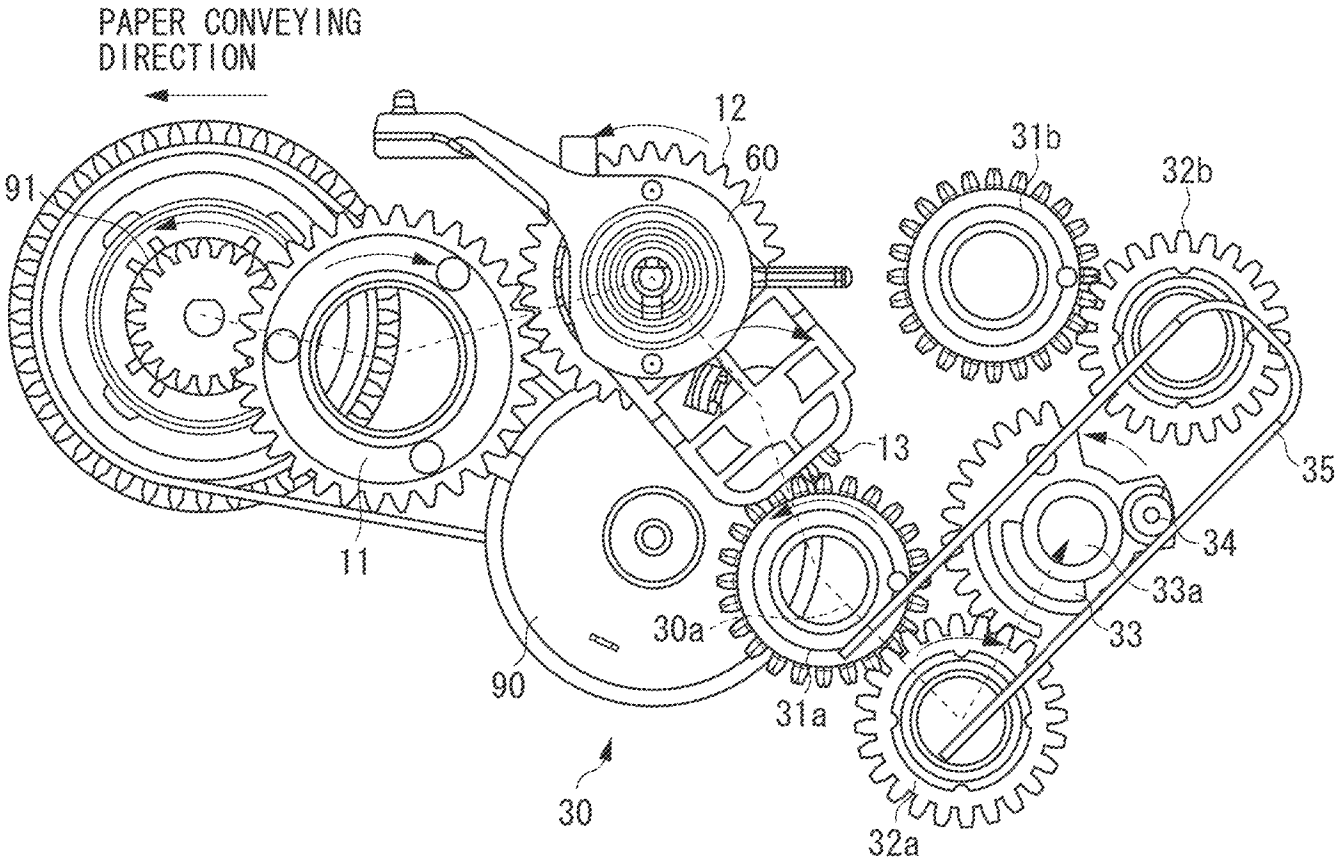
FIGS. 6A, 6B, and 6C are side views illustrating the selecting mechanism of the separating member provided in the recording apparatus according to the exemplary embodiment.
Figure 6B:
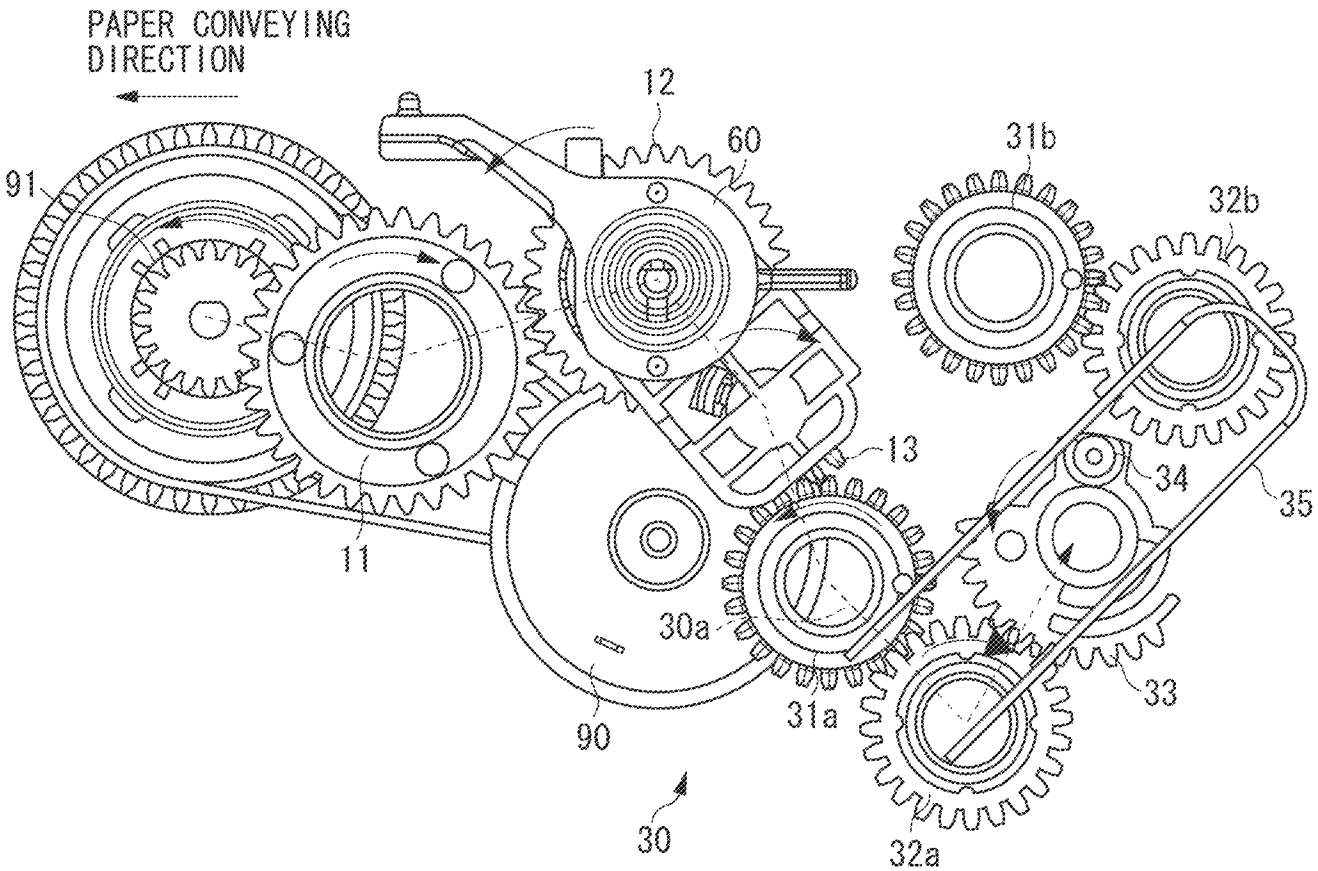
Figure 6C:
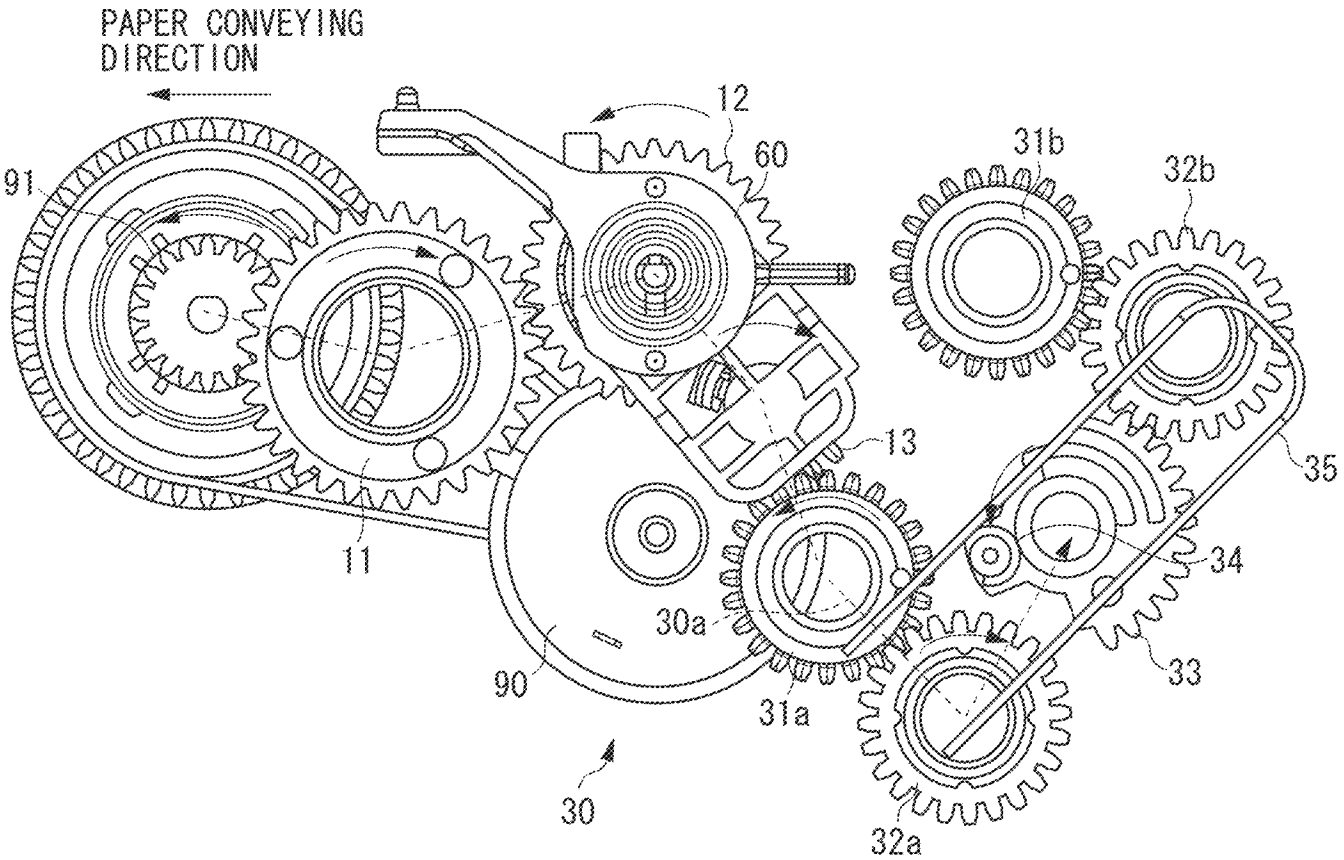

FIGS. 6A, 6B, and 6C illustrate detailed side views of the separating member selective-drive trains 30 in the recording apparatus according to the present exemplary embodiment. First, movement of the separating member selecting segment gear 33 when the planetary gear 13 is connected to the first separating member selective-drive train 30*a* as illustrated in FIG. 6A will be described.

In the state illustrated in FIG. 6A, the shaft 34 of the separating member selecting segment gear 33 is positioned between the arm part 35*a* and 35*b* of the torsion spring 35, and closer to the connection part 35*c* than a rotation shaft 33*a* of the separating member selecting segment gear 33. At this time, a segment part, which is a non-gear part of the separating member selecting segment gear 33, faces the second separating member selecting idler gear 32*b*. Thus, the second separating member selecting idler gear 32*b* cannot rotate the separating member selecting segment gear 33.

The shaft 34 abuts against the arm part 35*b* of the torsion spring 35, and cannot rotate clockwise. Thus, the torsion spring 35 restricts the separating member selecting segment gear 33 to rotate in one direction. In the state where the torsion spring 35 restricts the separating member selecting segment gear 33 to rotate in one direction, the gear part of the separating member selecting segment gear 33 meshes with a gear part of the first separating member selecting idler gear 32*a*.

The conveyance roller 91 rotating in the sheet conveying direction from the state illustrated in FIG. 6A rotates the idler gear 11, the sun gear 12, and the planetary gear 13 in this order. Then, the rotating planetary gear 13 rotates the first separating member selecting gear 31*a*, the first separating member selecting idler gear 32*a*, and the separating member selecting segment gear 33 in this order.

By further rotating the conveyance roller 91 in the sheet conveying direction, the shaft 34 abuts against the opposite arm part 35*a* as illustrated in FIG. 6B. Then, the separating member selecting segment gear 33 rotates while elastically deforming the arm part 35*a*. By further rotating the gear part of the separating member selecting segment gear 33, a meshing part between the separating member selecting segment gear 33 and the first separating member selecting idler gear 32*a* reaches the non-tooth part, which is the non-gear part of the separating member selecting segment gear 33. When the non-tooth part, which is the non-gear part of the separating member selecting segment gear 33, reaches the first separating member selecting idler gear 32*a*, the elastically deformed arm part 35*a* pushes the shaft 34, so that the separating member selecting segment gear 33 rotates by itself.

As illustrated in FIG. 6C, the separating member selecting segment gear 33 rotates to a state where the torsion spring 35 restricts the separating member selecting segment gear 33 the shaft 34 to rotate in one direction via, and the gear part of the separating member selecting segment gear 33 meshes with the gear part of the second separating member selecting idler gear 32*b*. In this state, rotation of the conveyance roller 91 does not rotate the separating member selecting segment gear 33 since the separating member selecting segment gear 33 and the first separating member selecting idler gear 32*a* do not mesh with each other.

Next, movement of the separating member selecting segment gear 33 when the planetary gear 13 is connected to the second separating member selective-drive train 30*b* will be described.

Figure 7A:
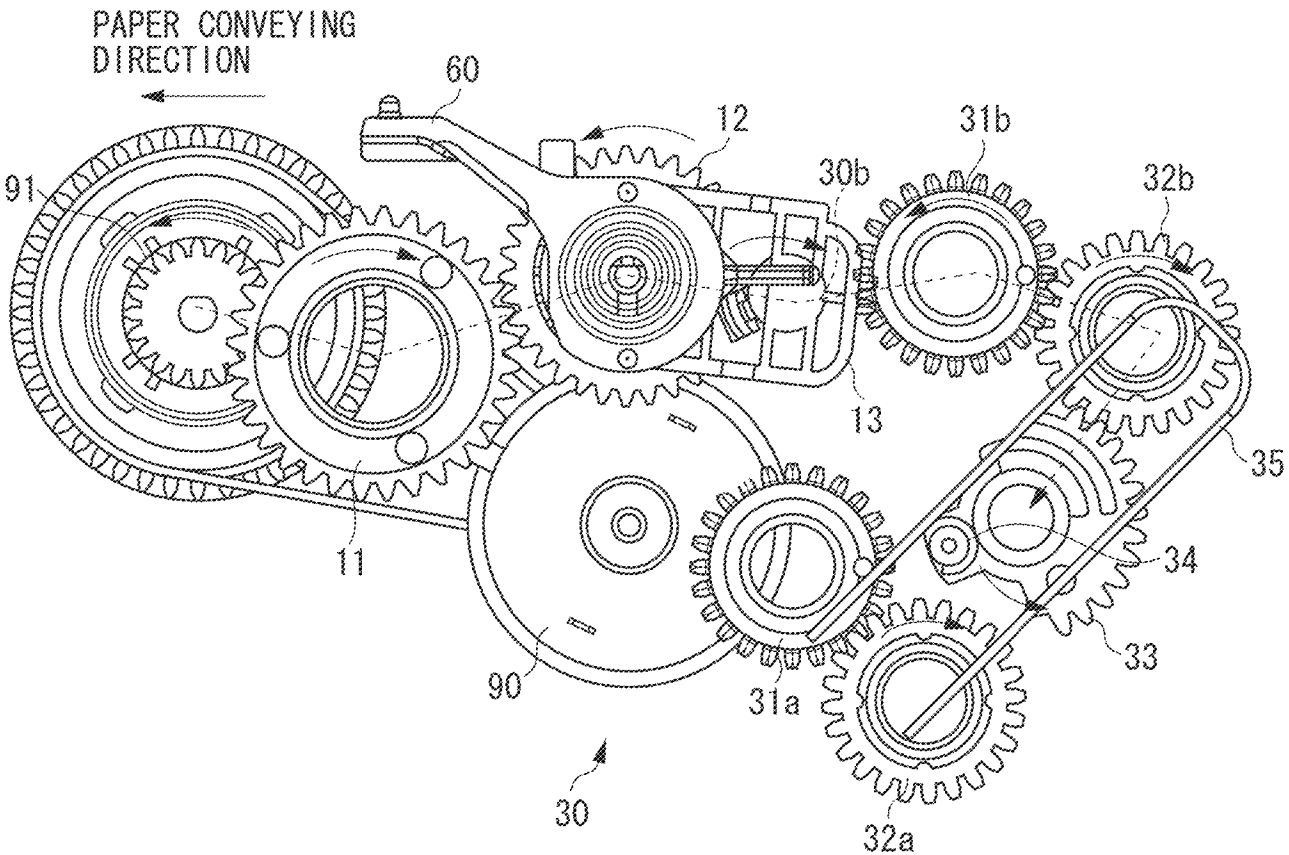
FIGS. 7A, 7B, and 7C are side views of the selecting mechanism of the separating member provided in the recording apparatus according to the exemplary embodiment.

When the torsion spring 35 restricts the shaft 34 of the separating member selecting segment gear 33 to rotate in one direction as illustrated in FIG. 7A, the gear part of the separating member selecting segment gear 33 meshes with the gear part of the second separating member selecting idler gear 32*b*.

The conveyance roller 91 rotating in the sheet conveying direction from the state illustrated in FIG. 7A rotates the idler gear 11, the sun gear 12, and the planetary gear 13 in this order. Then, the rotating planetary gear 13 rotates the second separating member selecting gear 31*b*, the second separating member selecting idler gear 32*b*, and the separating member selecting segment gear 33 in this order.

Figure 7B:
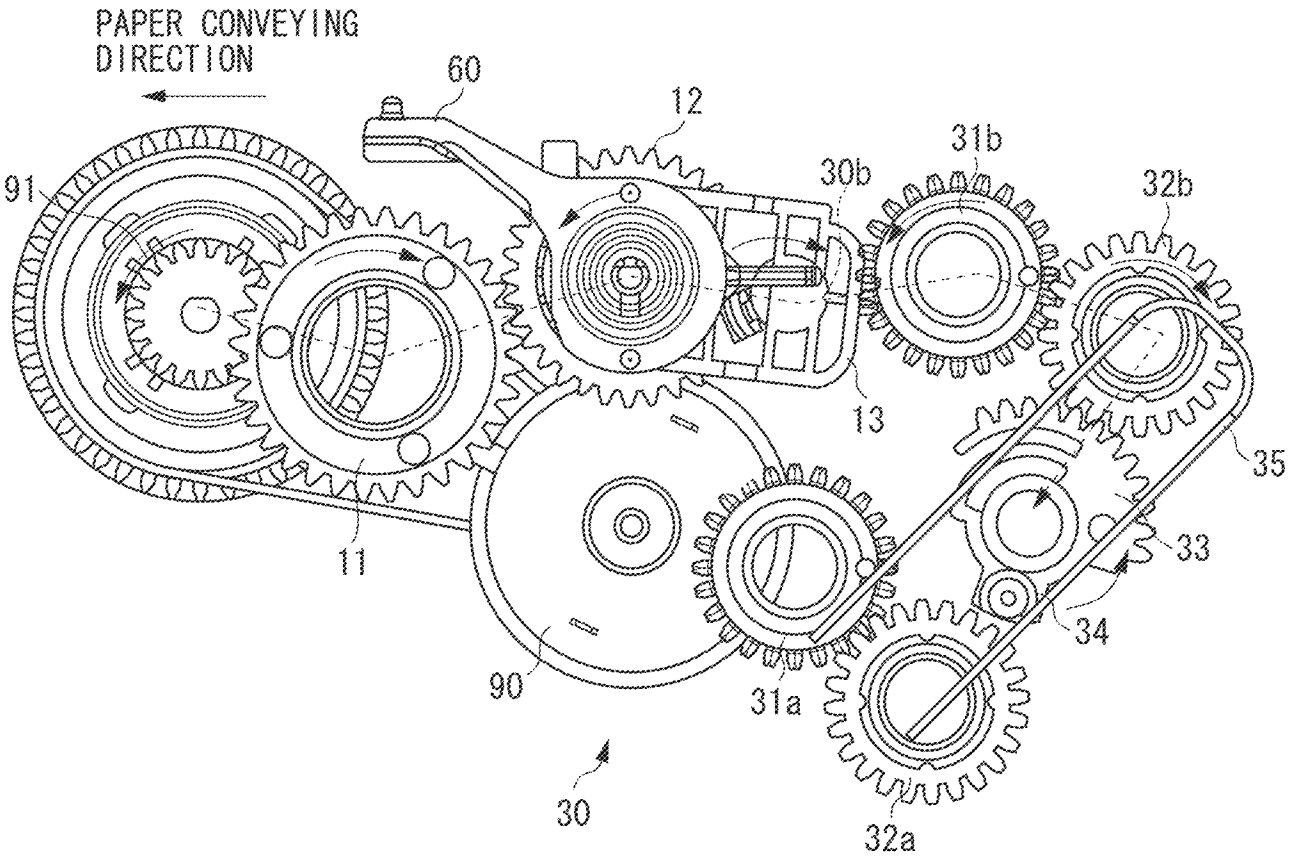

By further rotating the conveyance roller 91 in the sheet conveying direction, the shaft 34 abuts against the arm part 35*b* as illustrated in FIG. 7B. Then, the separating member selecting segment gear 33 rotates while elastically deforming the arm part 35*b*. By further rotating the gear part of the separating member selecting segment gear 33, a meshing part between the separating member selecting segment gear 33 and the second separating member selecting idler gear 32*b* reaches the non-tooth part, which is the non-gear part. At this time, the elastically deformed arm part 35*b* pushes the shaft 34, so that the separating member selecting segment gear 33 rotates by itself.

Figure 7C:
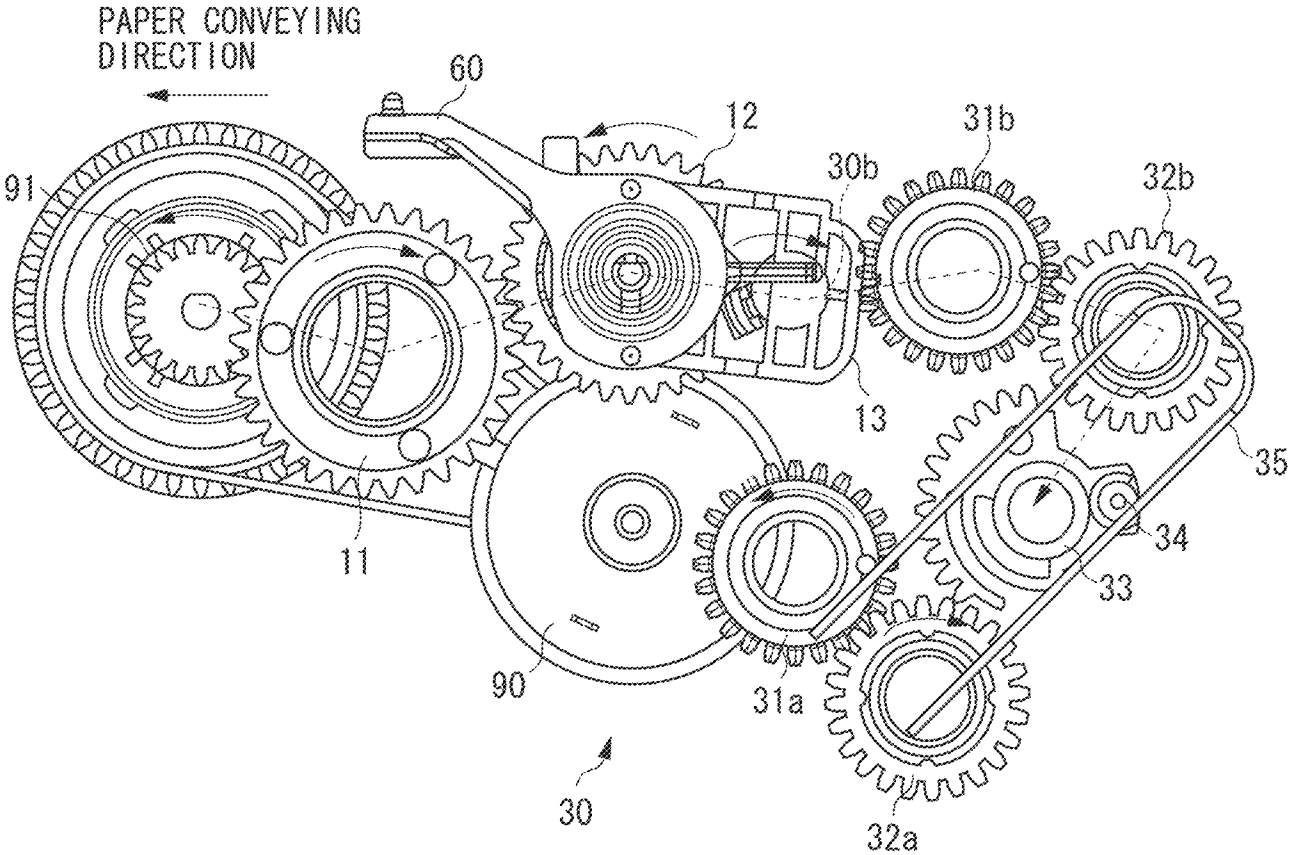

As illustrated in FIG. 7C, the separating member selecting segment gear 33 rotates to a state where the torsion spring 35 restricts the separating member selecting segment gear 33 via the shaft 34 to rotate in one direction, and the gear part of the separating member selecting segment gear 33 meshes with the gear part of the first separating member selecting idler gear 32*a*. In this state, rotation of the conveyance roller 91 does not rotate the separating member selecting segment gear 33 since the separating member selecting segment gear 33 and the second separating member selecting idler gear 32*b* do not mesh with each other.

Figure 8A:
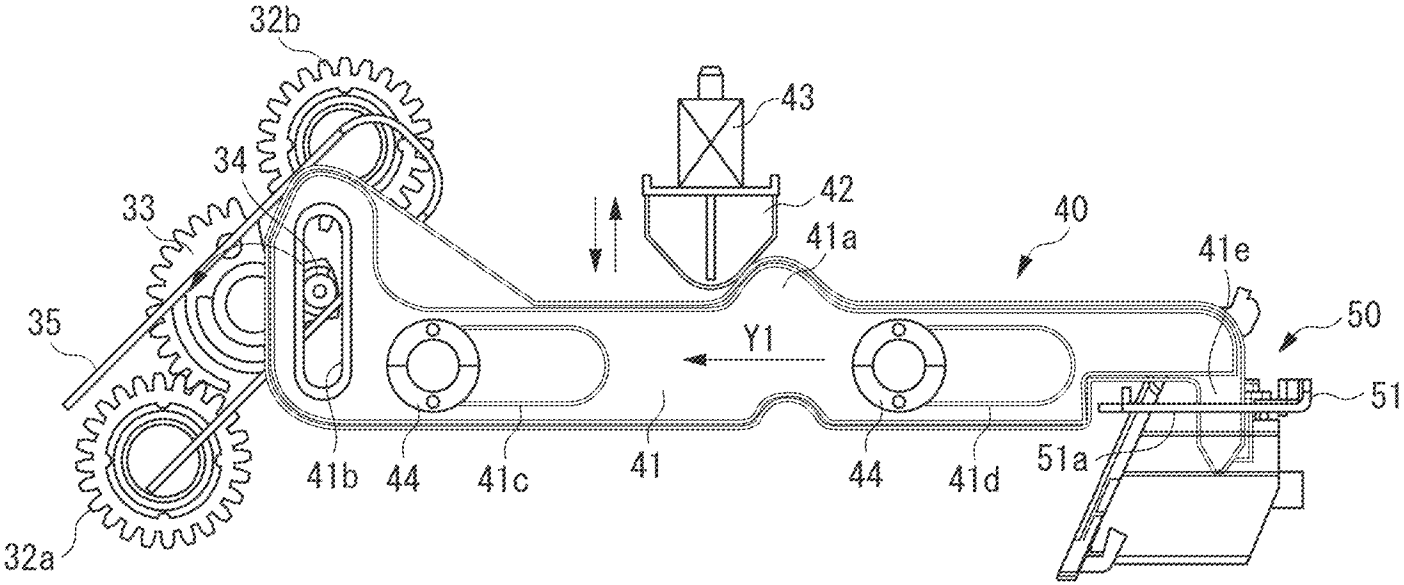
FIGS. 8A and 8B are side views illustrating the selecting mechanism of the separating member provided in the recording apparatus according to the exemplary embodiment.
Figure 8B:
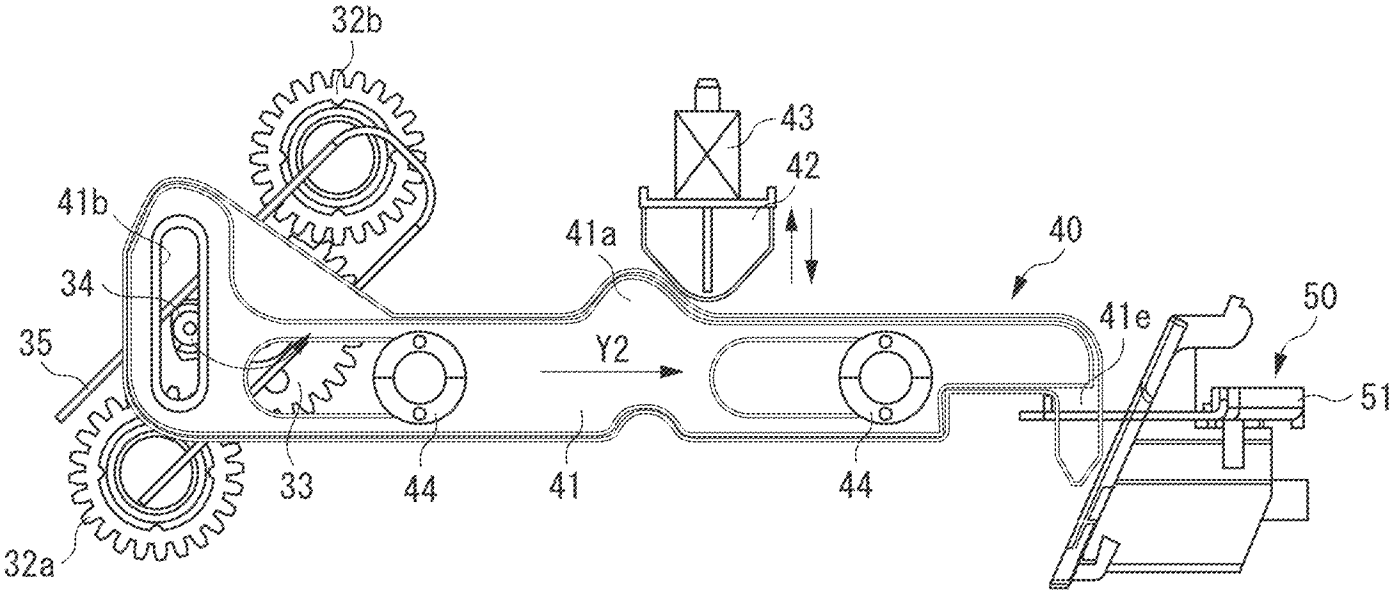

FIGS. 8A and 8B illustrate detailed side views of the separating member selecting lever unit 40 in the recording apparatus according to the present exemplary embodiment. A configuration of the separating member selecting lever unit 40 will be described with reference to FIG. 8A.

As illustrated in FIG. 8A, the separating member selecting lever unit 40 for selectively using the separating member 52 to be described below includes a separating member selecting lever 41 as a working lever for moving the position of the separating member 52 to work the separating member 52. The separating member selecting lever unit 40 also includes a position holding member for holding the position of the separating member selecting lever 41. The position holding member is configured to include a toggle bar 42 for restricting the position of the separating member selecting lever 41, a toggle bar spring for urging the toggle bar 42, and bushings 44 for supporting the separating member selecting lever 41 movably.

The separating member selecting lever 41 is formed with long holes 41*c* and 41*d* extending in the longitudinal direction. Due to the bushings 44 passing through the long holes 41*c* and 41*d*, the apparatus body holds the separating member selecting lever 41 movably in directions of arrows Y1 and Y2 in FIG. 8A. The toggle bar spring 43 urges the toggle bar 42, and the toggle bar 42 abuts against a protrusion 41*a* of the separating member selecting lever 41.

The separating member selecting lever 41 is formed with an oval hole 41*b* at one end thereof, and the shaft 34 of the separating member selecting segment gear 33 is inserted through the oval hole 41*b*. The separating member selecting lever 41 is provided with an arm portion 41*e* at the other end thereof, and the arm portion 41*e* is connected to the separating member unit 50. Specifically, the arm portion 41*e* passes through a separating member selecting lever insertion hole 51*a* formed in the separating member moving lever 51 as illustrated in FIG. 9, whereby the arm portion 41*e* is connected to the separating member unit 50.

FIG. 8A illustrates a case where the planetary gear 13 is connected to the first separating member selective-drive train 30*a*. Rotation of the separating member selecting segment gear 33 moves the shaft 34 in the direction of the arrow Y1 while moving in the longitudinal direction of the oval hole 41*b* of the separating member selecting lever 41. The shaft 34 moving in the direction of the arrow Y1 while pushing the separating member selecting lever 41 from the inside of the oval hole 41*b* moves the separating member selecting lever 41 in the direction of the arrow Y1. The separating member selecting lever 41 moves in the direction of the arrow Y1 while the protrusion 41*a* thereof pushes up the toggle bar 42. When the protrusion 41*a* passes over the toggle bar 42, the toggle bar 42 conversely pushes down the protrusion 41*a*, thereby urging the separating member selecting lever 41 to move in the direction of the arrow Y1. When the separating member selecting segment gear 33 rotates substantially half round, the separating member selecting lever 41 abuts against the bushings 44 and is restricted from moving. Thus, the separating member selecting lever 41 stops. At this time, the toggle bar 42 urges the separating member selecting lever 41, and thereby holding the separating member selecting lever 41 not to easily move in the direction opposite to the direction of the arrow Y1.

FIG. 8B illustrates a case where the planetary gear 13 is connected to the second separating member selective-drive train 30*b*. Rotation of the separating member selecting segment gear 33 moves the shaft 34 in the direction of the arrow Y2 while moving inside the oval hole 41*b* of the separating member selecting lever 41. The shaft 34 moving in the direction of the arrow Y2 while pushing the separating member selecting lever 41 from the inside of the oval hole 41*b* moves the separating member selecting lever 41 in the direction of the arrow Y1. The separating member selecting lever 41 moves in the direction of the arrow Y2 while the protrusion 41*a* thereof pushes up the toggle bar 42. When the protrusion 41*a* passes over the toggle bar 42, the toggle bar 42 conversely pushes down the protrusion 41*a*, thereby urging the separating member selecting lever 41 to move in the direction of the arrow Y2. When the separating member selecting segment gear 33 rotates substantially half round, the separating member selecting lever 41 abuts against the bushings 44 and is restricted from moving. Thus, the separating member selecting lever 41 stops. At this time, the toggle bar 42 urges the separating member selecting lever 41, thereby holding the separating member selecting lever 41 not to easily move in the direction opposite to the direction of the arrow Y2.

Figure 9A:
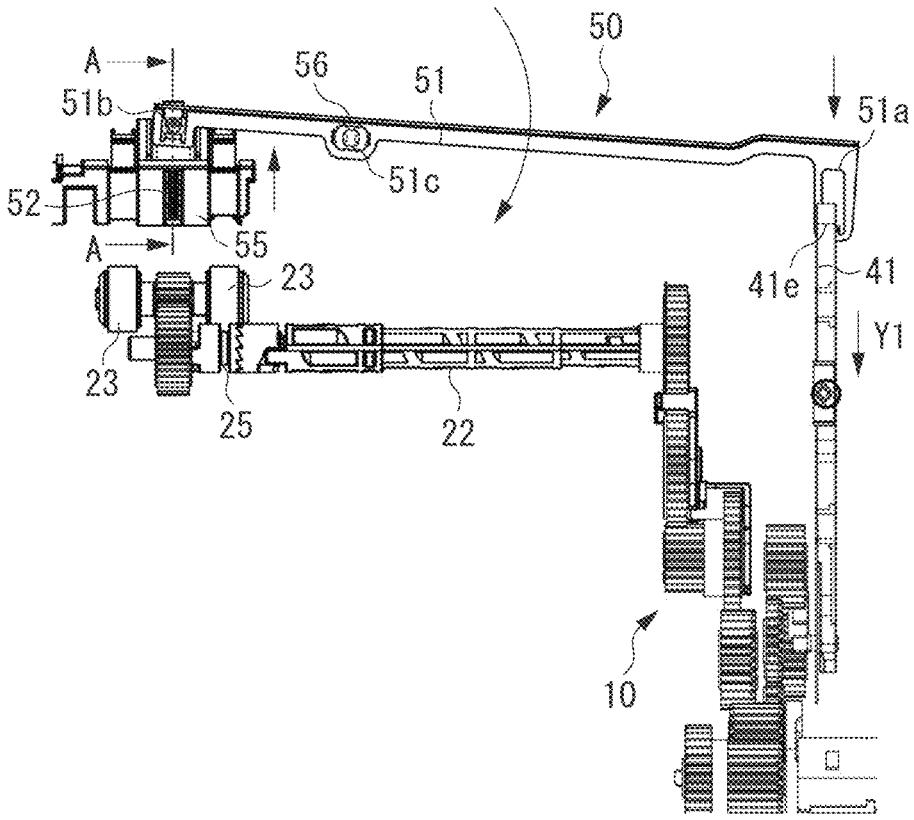
FIGS. 9A and 9B are views illustrating the selecting mechanism of the separating member provided in the recording apparatus according the exemplary embodiment.
Figure 9B:
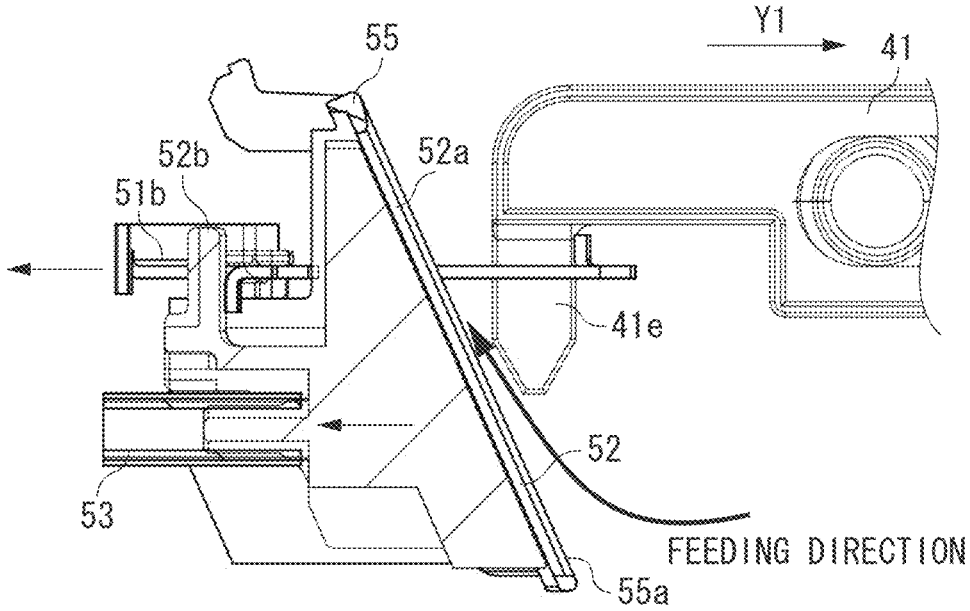

FIGS. 9A and 9B illustrate views for describing a configuration of the separating member selecting lever 41 and the separating member unit 50 according to the present exemplary embodiment. FIG. 9A illustrates a plan view and FIG. 9B illustrates a partial sectional view of the separating member selecting lever 41 and the separating member unit 50 according to the present exemplary embodiment.

FIGS. 9A and 9B illustrate movement of the separating member unit 50 when the separating member selecting lever 41 moves in the direction Y1. The separating member unit 50 includes the separating member 52, the separating inclined surface 55, on which the separating member 52 moves back and forth, and the separating member moving lever 51 for moving the separating member 52. The separating member unit 50 also includes a separating spring 53 configured to urge the separating member 52 to protrude the separating member 52 from the separating inclined surface 55, and a lever bushing 56 functioning as a pivot of turn of the separating member moving lever 51.

On the sheet-side surface 52*a* of the separating member 52, the serrated-shaped part, against which the edge in the conveying direction of a sheet being fed abuts, is formed. The separating member 52 applies resistance to a sheet by causing the serrated-shaped part thereof to abut against the sheet, thereby enabling smooth separation of sheets one by one.

As illustrated in FIG. 9A, the separating member moving lever 51 is formed with the separating member selecting lever insertion hole 51*a*, into which the arm portion 41*e* is inserted, at the arm portion 41*e* side of the separating member selecting lever 41. The separating member moving lever 51 is also formed with a shaft insertion hole 51*b*, into which a shaft 52*b* is inserted, at the shaft 52*b* side of the separating member 52. The separating member moving lever 51 is also formed with a lever bushing insertion hole 51*c*, with which the lever bushing 56 engages, at a position between the separating member selecting lever insertion hole 51*a* and the shaft insertion hole 51*b*.

When the separating member selecting lever 41 moves in the direction Y1, the separating member moving lever 51 turns clockwise about the lever bushing 56 as a pivot of turn, and the shaft insertion hole 51*b* moves in the direction opposite to the direction Y1. Thus, the shaft 52*b* contacts with the inner edge of the shaft insertion hole 51*b*. After the shaft 52*b* contacts the inner edge of the shaft insertion hole 51*b*, the inner edge of the shaft insertion hole 51*b* moves the shaft 52*b* in the direction opposite to the direction Y1. The shaft 52*b* moving in the direction opposite to the direction Y1 moves the separating member 52 via the shaft 52*b* in the direction opposite to the direction Y1. When the separating member selecting lever 41 finishes moving in the direction Y1, the surface 52*a* of the separating member 52 has moved to the retracting position where the surface 52*a* recedes from the surface 55*a* of the separating inclined surface 55.

Therefore, the feed roller 23 can feed a sheet in a state where the surface 52*a* of the separating member 52 is retracted from the surface 55*a* of the separating inclined surface 55. When the feed roller 23 is driven and the separating member 52 is moved at the same time, the delay mechanism 25 is previously incorporated to delay rotation of the feed roller 23 with respect to movement of the separating member 52. The use of the delay mechanism 25 enables to start feed operation by the feed roller 23 after the movement of the separating member 52. As described above, by moving the separating member 52 to the retracting position where the separating member 52 is retracted from the sheet conveyance path, a sheet having been fed does is separated by the separating inclined surface 55 without abutting against the separating member 52. By moving the separating member 52 to the retracting position where the separating member 52 is retracted from the sheet conveyance path upon feed of a soft sheet or glossy paper, bending or damage on a sheet can be prevented.

Figure 10A:
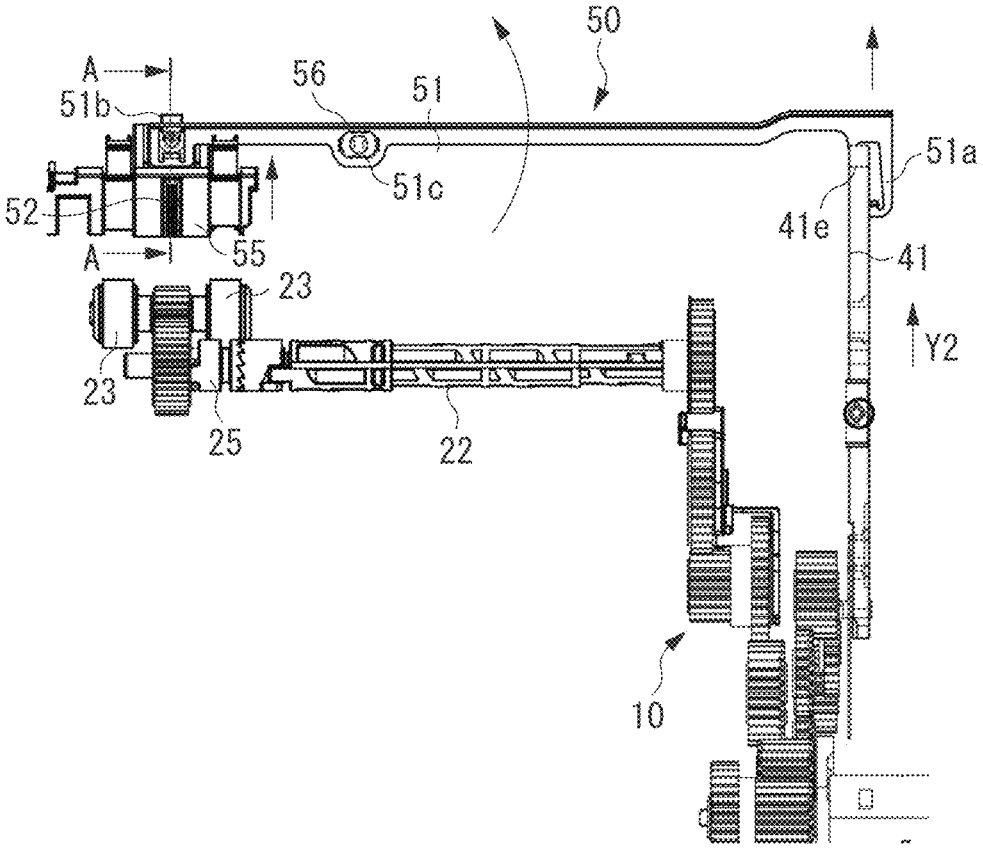
FIGS. 10A and 10B are views illustrating the selecting mechanism of the separating member provided in the recording apparatus according the exemplary embodiment.
Figure 10B:
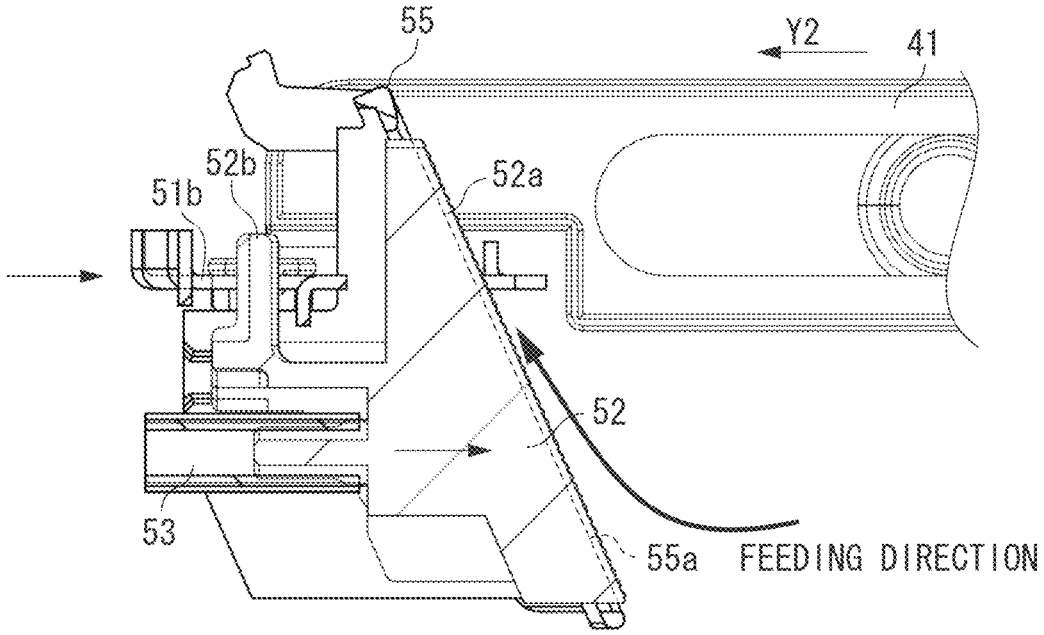
Figure 11:
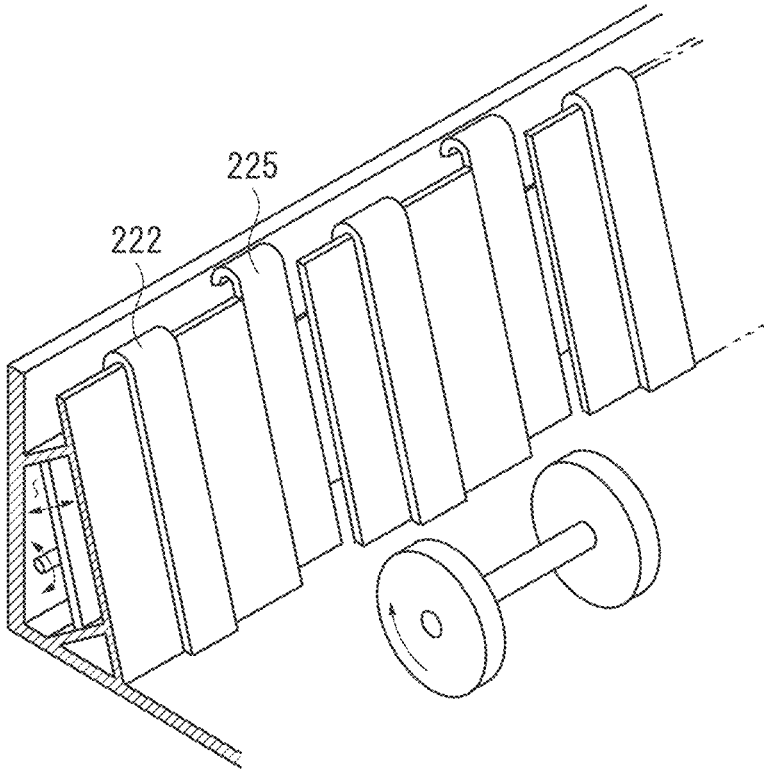
FIG. 11 is a perspective view illustrating a main section of a conventional recording apparatus.
Figure 12:
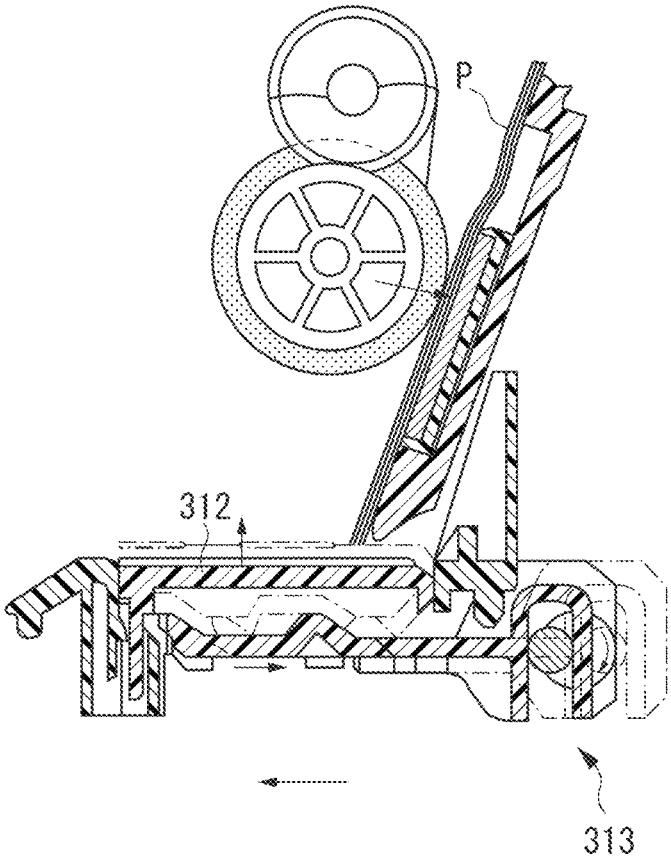
FIG. 12 is a sectional view illustrating a main section of a conventional recording apparatus.

FIGS. 10A and 10B illustrate movement of the separating member unit 50 when the separating member selecting lever 41 moves in the direction Y2.

As illustrated in FIGS. 10A and 10B, when the separating member selecting lever 41 moves in the direction Y2, the separating member moving lever 51 turns anticlockwise about the lever bushing 56 as a pivot of turn, and the inner edge of the shaft insertion hole 51*b* moves in a direction away from the shaft 52*b* side. When the inner edge of the shaft insertion hole 51*b* is away from the shaft 52*b* side, urging force of the separating spring 53 moves the surface 52*a* of the separating member 52 to the separating position where the surface 52*a* protrudes from the surface 55*a* of the separating inclined surface 55. Therefore, the feed roller 23 can feed a sheet in a state where the surface 52*a* of the separating member 52 is moved to the separating position where the surface 52*a* protrudes from the surface 55*a* of the separating inclined surface 55. When the surface 52*a* of the separating member 52 protrudes in the separating position, the serrated-shaped part formed on the surface 52*a* applies resistance to a sheet having poor separation performance, so that separation performance can be improved.

As described above, according to the present exemplary embodiment, a time required for moving a separating member can be reduced without providing a phase detecting unit for detecting a phase (turning position) of a separating member by sharing a drive source for feed operation.

Other exemplary embodiments include a configuration example where a friction member (not illustrated) for applying friction force to a sheet is provided on the surface 52*a* of the separating member 52 on the sheet side, a configuration example where a claw member is used as a separating member, and a configuration example where a sheet side inclined surface has a gradient with respect to the separating inclined surface 55.

In the above exemplary embodiment, the separating member is configured to be movable to two positions. The separating member, however, may be configured to be movable to three or more positions, and may be configured to include three or more separating member selective-drive trains.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-190012 filed Aug. 30, 2012, which is hereby incorporated by reference herein in its entirety.

What is claimed is:

1. A feeding device comprising:

a drive source;

a feed roller configured to feed stacked sheets;

a first transmission unit configured to transmit driving force of the drive source to the feed roller;

a separating inclined surface configured to separate a sheet having been fed by the feed roller;

a separating member, having a surface for separating a sheet having been fed by the feed roller from the other sheets, configured to be capable of setting a separating position where the surface of the separating member protrudes from the separating inclined surface so as to be in contact with a sheet for separating the sheet from the other sheets and a retracting position where the surface of the separating member does not protrude from the separating inclined surface such that the separating inclined surface being in contact with a sheet to separate the sheet from the other sheets;

a moving unit configured to move the separating member to the separating position and the retracting position; and a second transmission unit configured to transmit driving force of the drive source to the moving unit to work the moving unit, wherein the second transmission unit includes a first part and a second part which receive driving force from a third transmission unit, transmits driving force received at the first part to the moving unit to move the separating member from the retracting position to the separating position, and transmits driving force received at the second part to the moving unit to move the separating member from the separating position to the retracting position, and wherein the second transmission unit does not transmit driving force received at the first part when the separating member is at the separating position, and does not transmit driving force received at the second part when the separating member is at the retracting position.

2. The feeding device according to claim 1 wherein the first transmission unit includes a delay unit configured to transmit, with a delay, driving force of the drive source to the feed roller.

3. The feeding device according to claim 2 wherein the delay unit transmits the driving force after the moving unit moves the separating member.

4. The feeding device according to claim 1 wherein the second transmission unit includes a gear on a circumference thereof, the gear being provided with a gear part configured to transmit driving force and a non-gear part configured not to transmit driving force, the gear part of the gear transmits driving force received at the first part when the separating member is at the retracting position, and the non-gear part does not transmit driving force received at the first part when the separating member is at the separating position.

5. The feeding device according to claim 1 wherein the second transmission unit includes a gear on a circumference thereof, the gear being provided with a gear part configured to transmit driving force and a non-gear part configured not to transmit driving force, the gear part of the gear transmits driving force received at the second part when the separating member is at the separating position, and the non-gear part does not transmit driving force received at the second part when the separating member is at the retracting position.

6. A recording apparatus comprising:

the feeding device according to claim 1; and a recording unit configured to perform recording on the sheet fed by the feeding device.

7. The feeding device according to claim 1, wherein the retracting position is a position where the surface of the separating member recedes from the separating inclined surface. position.

8. The feeding device according to claim 1, wherein the moving unit moves the separating member to the separating position in a case where sheets to be separated are predetermined sheets and the moving unit moves the separating member to the retracting position in a case where sheets to be separated are softer than the predetermined sheet.

9. A feeding device comprising:

a feed roller configured to feed stacked sheets;

a separating inclined surface configured to separate a sheet having been fed by the feed roller;

a separating member, having a surface for separating a sheet having been fed by the feed roller from the other sheets, configured to be capable to set a separating position where the surface of the separating member protrudes from the separating inclined surface so as to be in contact with a sheet for separating the sheet from other sheets and a retracting position where the surface of the separating member does not protrude from the separating inclined surface such that the separating inclined surface being in contact with a sheet to separate the sheet from the other sheets;

a moving unit configured to move the separating member to the separating position and the retracting position ; and a transmission unit configured to transmit driving force to the moving unit to work the moving unit, wherein the transmission unit includes a first part and a second part which receive driving force from a drive source, transmits driving force received at the first part to the moving unit to move the separating member from the retracting position to the separating position, and transmits driving force received at the second part to the moving unit to move the separating member from the separating position to the retracting position, and wherein the transmission unit does not transmit driving force received at the first part when the separating member is at the separating position, and does not transmit driving force received at the second part when the separating member is at the retracting position.

10. The feeding device according to claim 9 wherein the transmission unit includes a gear on a circumference thereof, the gear being provided with a gear part configured to transmit driving force and a non-gear part configured not to transmit driving force, the gear part of the gear transmits driving force received at the first part when the separating member is at the retracting position, and the non-gear part does not transmit driving force received at the first part when the separating member is at the separating position.

11. The feeding device according to claim 9 wherein the transmission unit includes a gear on a circumference thereof, the gear being provided with a gear part configured to transmit driving force and a non-gear part configured not to transmit driving force, the gear part of the gear transmits driving force received at the second part when the separating member is at the separating position, and the non-gear part does not transmit driving force received at the second part when the separating member is at the retracting position.

12. A recording apparatus comprising:

the feeding device according to claim 9; and a recording unit configured to perform recording on the sheet fed by the feeding device.

13. The feeding device according to claim 9, wherein the retracting position is a position where the surface of the separating member recedes from the separating inclined surface.

14. The feeding device according to claim 9, wherein the moving unit moves the separating member to the separating position in a case where sheets to be separated are predetermined sheets and the moving unit moves the separating member to the retracting position in a case where sheets to be separated are softer.

* * * * *